United States Patent [19]

Marshall

[11] 4,083,913

[45] Apr. 11, 1978

[54] STABILIZATION OF MIXED-FIBER WEBS

[75] Inventor: Preston F. Marshall, Walpole, Mass.

[73] Assignee: The Kendall Company, Boston, Mass.

[21] Appl. No.: 425,106

[22] Filed: Dec. 17, 1973

Related U.S. Application Data

[63] Continuation-in-part of Ser. No. 204,619, Dec. 3, 1971, abandoned.

[51] Int. Cl.[2] ..... B27J 5/00

[52] U.S. Cl. ..... 264/121; 264/122; 264/126

[58] Field of Search ..... 264/121, 122, 125, 126

[56] References Cited

U.S. PATENT DOCUMENTS

| | | | |
|---|---|---|---|
| 2,277,049 | 3/1942 | Reed | 264/122 |
| 3,229,008 | 1/1966 | Harrington, Jr. et al. | 264/122 |
| 3,577,290 | 5/1971 | Baskerville, Jr. et al. | 156/62.2 |

*Primary Examiner*—Jan H. Silbaugh
*Assistant Examiner*—James R. Hall
*Attorney, Agent, or Firm*—Edward J. Scahill, Jr.

[57] ABSTRACT

Air-laid fibrous webs are formed from randomly-oriented mixed fibers containing a minor proportion of short, flock-length, thermoplastic and thermoretractile fibers. The air-laid web is then heated, without pressure, to cause melting of the thermoplastic fibers to the point of substantially complete loss of fiber identity. The relative orientation of the web thus formed is stabilized so that the fibers therein maintain their general positional relationships through subsequent stresses incurred during the operations of printing, saturating, drying, winding into roll form and the like.

4 Claims, 6 Drawing Figures

STABILIZATION OF MIXED-FIBER WEBS

CROSS REFERENCE TO OTHER APPLICATIONS

This application is a continuation-in-part of my copending application Ser. No. 204,619, filed Dec. 3, 1971, now abandoned.

BACKGROUND OF THE INVENTION

This invention relates to a process for stabilizing the fiber orientation and fiber distribution in webs of textile-length fibers which are intended to be eventually processed into non-woven fabrics. More particularly it relates to a process for bonding the fibers of a fibrous web, using short binder fibers, so that they maintain their general positional relationships through subsequent operations of drafting, printing, saturating, drying, winding into roll form, and the like.

Nonwoven fabrics are a recognized article of commerce widely used for the formation of disposable or semi-disposable articles such as sheets, pillowcases, hospital gowns and drapes, wiping cloths, dusters, and for a wide variety of other purposes. The most common type of nonwoven fabric is that which is formed by saturating or impregnating with a polymeric dispersion or latex an unspun, unwoven, intermingled array of textile-length fibers delivered from a card, garnett, or air-lay machine. By far the most common web-forming device is a so-called card or carding machine, which comprises a cylinder, three to four feet in diameter, and of any desired width, covered with a multiplicity of fine bent wires called teeth or card clothing. A lap or roll of fibers is fed by means of a so-called licker-in roll to this cylinder, which picks up and carries a fleece or veil of fibers. The fibers are also worked upon by auxiliary rolls or flat strips covered with wire teeth and set in close proximity to the circumference of the cylinder. The fibrous web is removed from the cylinder by a doffing device, which is conventionally a secondary wire-covered cylinder tangential to the main cylinder and revolving in the opposite direction. From the doffer, the web is removed and forwarded for further processing by a vibrating comb or similar device.

The conventional card or carding machine was primarily devised to exert a two-fold effect. First, it cleaned an array of fibers such as raw cotton or wool, removing considerable dirt, other foreign matter, and short fibers. Second, it tended to parallelize and rearrange the fibers, which was then a desirable consequence since the fibrous card web was customarily further drafted and spun into yarn in a multi-stage process.

With the advent of the nonwoven fabric industry, however, many cards were converted from their original function of preparing a sliver of parallel fibers to delivering a full-width web or a plurality of such webs to a conveyor belt, for subsequent bonding to form a nonwoven fabric. One of the previous advantages of carding, parallelization of the fibers, became a distinct disadvantage in the preparation of nonwoven fabrics. Spun yarns have strength only in the lengthwise direction, where the strength is needed for conventional weaving purposes, whereas the majority of nonwoven fabrics must have at least some minimal tensile strength in the transverse or cross-web direction. The problem is particularly acute in the case of nonwoven fabrics prepared from man-made fibers, which, although they may be crimped, are generally straighter and much more readily oriented than natural fibers such as cotton.

A further complication is that the conventional processing of bonded nonwoven fabrics consists of a set of stages — conveying, saturating, drying, winding, etc. — all of which impose a further drafting and parallelizing effect on the fibrous web, since the web is being stretched under tension in each of these operations. If a web is carefully removed from the doffer of a card and then is bonded to form a nonwoven fabric with careful handling to avoid drafting or distortion, the longitudinal (machine direction or M.D.) tensile strength may be only 3 or 4 times the lateral (cross-direction or C.D.) tensile strength. In conventional multi-stage bonding and drying operations, however, wherein the web is pulled under tension in each processing stage, tensile strength ratios of 10 or 20 to 1 are found, M.D. to C.D.

Various expedients are resorted to for improving what will hereinafter be referred to simply as the strength ratio, it being understood that this refers to the ratio of strength in the machine or longitudinal direction to the cross or lateral direction. One expedient is to disperse the fibers in more or less random orientation into an air stream, from which they are collected on a perforated rotating drum by suction. Such devices are expensive, and clumping and poor fiber dispersion appear at the speeds of 30 to 50 yards per minute at which it is economical to process nonwoven fabrics.

Another common method of improving the strength ratio is by means of a cross-laying device, whereby a full-width web of oriented fibers is mechanically pleated back and forth across a conveyor belt to build up a composite batt in which the average angular displacement of the fibers is alternated. Such devices again are slow, cumbersome, and are suitable only for batts of substantial thickness where fold marks and overlap ridges are not objectionable.

Other auxiliary devices have been proposed to randomize carded webs, such as that set forth in U.S. Pat. No. 3,538,552 to J. L. Foley, of common assignee.

Still other devices for creating webs in which the fibers lie in more or less random orientation are described in my copending application Ser. No. 159,229, filed July 2, 1971, and U.S. Pat. No. 3,727,270, issued Apr. 17, 1973. In these applications, textile-length fibers are accelerated and drafted through aspirators, diffused and decelerated in a plenum chamber, and eventually collected in the form of randomly-oriented webs.

However, as set forth above, devices which randomize fibrous webs from the various types of web-forming devices are generally ineffective in maintaining a favorable M.D. — C.D. strength ratio during the subsequent operations of saturating and drying, which are essential steps in the preparation of most bonded nonwoven fabrics. The fibrous webs are drawn or drafted through the bonding and drying steps, and since the fibers are only casually engaged by frictional forces, they become gradually more and more oriented in the machine direction — that is, lengthwise of the web. In this way, a random web which is delivered from the web former with approximately the same crosswise as lengthwise strength may show a M.D. tensile strength which is 4 or 5 times the C.D. strength after complete processing. In products where the C.D. strength is a controlling or essential factor, this means that the nonwoven fabrics must be made heavier than need be, to meet the minimum crosswise strength requirement, which is a wasteful expedient.

This invention is directed toward the use of short thermoplastic, thermoretractile fibers as a prebond for increasing the strength ratio of a web preliminary to the subsequent operations of saturating, drying and the like. It is known to subject fibrous webs comprising a mixture of thermoplastic and non-thermoplastic fibers to heat, in order to form a nonwoven web, as taught by Reed in U.S. Pat. No. 2,277,049 and by Harrington, Jr. et al in U.S. Pat. No. 3,229,008. However, the teaching in both such instances relates to carded or garnetted webs in which both the thermosensitive and non-thermosensitive fibers are of textile-length, that is, capable of being formed into webs by dry-lay mechanical processing. These thermosensitive fibers have sufficient length, therefore, to become reticulately entwined with the similarly long non-thermosensitive fibers. Since these fibers are entwined, or interlaced, with adjoining fibers, then, upon heating in the absence of pressures, when these thermosensitive fibers go through the process of retraction or fiber shrink, they pull the non-thermosensitive into an area contraction. This shrinkage of the textile-length thermosensitive fibers sets up a shrinkage tendency in the web as a whole, since the retracting fibers, spanning over, and interlaced with, many non-thermosensitive fibers draw these fibers together as retraction sets in. As a practical matter, therefore, the bonding processes in U.S. Pat. Nos. 2,277,049 and 3,229,008 are always carried out under pressure if undesirable shrinkage is to be avoided. Although the use of a pressure nip has eliminated this shrink, it has done so under the penalty of compressing the fabric, destroying its loft, and introducing processing difficulties.

Accordingly, it is an object of this invention to provide a process for making a web of mixed thermosensitive and non-thermosensitive fibers which can be heated at zero pressure to activate the thermosensitive (binder) fibers without significant shrinkage of the web, while enhancing the homogeniety of the distribution of those binder fibers within the web.

It is another object of the present invention to provide a process that stabilizes the fibers in an air-laid randomly oriented web against the gross distortion and reorientation which they normally are subject to in subsequent bonding and drying operations.

It is a further object of the invention to provide a method of making a bonded air-laid web wherein a substantial number of the fibers in the web are bonded only at their crossover points, whereby the web remains flexible, and substantially uncondensed.

Still another object of the invention is to provide a process that limits the maximum size of the bead resulting from the melting of a thermoplastic fiber.

SUMMARY OF THE INVENTION

The relative orientation and distribution of the fibers in an air-laid web is stabilized by means of a zero pressure thermoplastic prebond. The web is formed of non-thermally sensitive fibers having admixed therewith in random distribution and oriented throughout the length, breadth and depth of the web, a minor proportion of short fibers of a drawn, thermoplastic and thermoretractile nature which liquefy at a temperature below the melting point of the non-thermally sensitive fibers. The mixed fiber web is heated, at zero pressure, to a temperature sufficient to cause the drawn, thermoretractile fibers to retract and melt to a series of fluid beads with substantially complete loss of fiber identity, the beads locating principally at the crossover points of the non-thermally sensitive fibers. When the web is cooled, the fluid beads solidify so as to act as a restorative force that stabilizes the relative orientation and distribution of the non-thermally sensitive fibers.

DESCRIPTION OF THE PREFERRED EMBODIMENTS

The basic steps of the present invention comprise the formation of an air-borne diffusion of a minor proportion of short thermoplastic and thermoretractile fibers, preferably between 0.05 and 0.40 inches in length, together with a major portion of fibers which are not thermally sensitive at the temperature at which the thermoretractile fibers are affected; collecting the mixture of fibers in the form of a fleece or web in which both types of fibers are randomly arrayed; subjecting the mixed fiber web to a heating operation, without pressure, to cause the thermoretractile fibers to retract and melt into a series of fluid beads, with substantial loss of fiber identity; and cooling the web until the beads formed from the thermoretractile fibers have solidified, so as to act as a restorative force that stabilizes the relative orientation and distribution of the non-thermally sensitive fibers.

As may be seen from the flow diagram, FIG. 1, various methods of initial fiber preparation are used, depending on fiber length, as explained below. The different classes of fibers are fed through air jets to form a mixed fiber diffusion in a fluid stream, usually air, said machine terminating in a porous screen onto which a mixed-fiber web is deposited, for subsequent bonding and winding up. If space allows, further processes of saturating or printing may be done in-line, bypassing the winding operation.

The heating process is carried out while the fibers are randomly arrayed and in unstressed condition, preferably supported on an air-permeable conveyor belt. In this manner, the non-thermally affected fibers are bonded at a sufficient number of their points of intersection that although the web is open, porous, and flexible, and although the fibers are capable of temporary displacement, there is a constant restorative force that minimizes the permanent drafting — i.e., slippage of fiber past fiber — and hence minimizes the tendency of subsequent operations to reorient the fibers into a direction more nearly parallel to the machine direction of the web.

In the present invention, on the other hand, the thermoplastic and thermoretractile fibers are short, and are heated under substantially zero pressure, until their identity as fibers is completely lost, and they appear as beads or droplets of thermoplastic material substantially all of which are located at the crossover points where the non-thermosensitive fibers intersect. Because of the short length of these fibers, they are not interlaced with adjoining fibers, and, therefore, do not cause web shrinkage — even at zero pressure.

Figure 1:
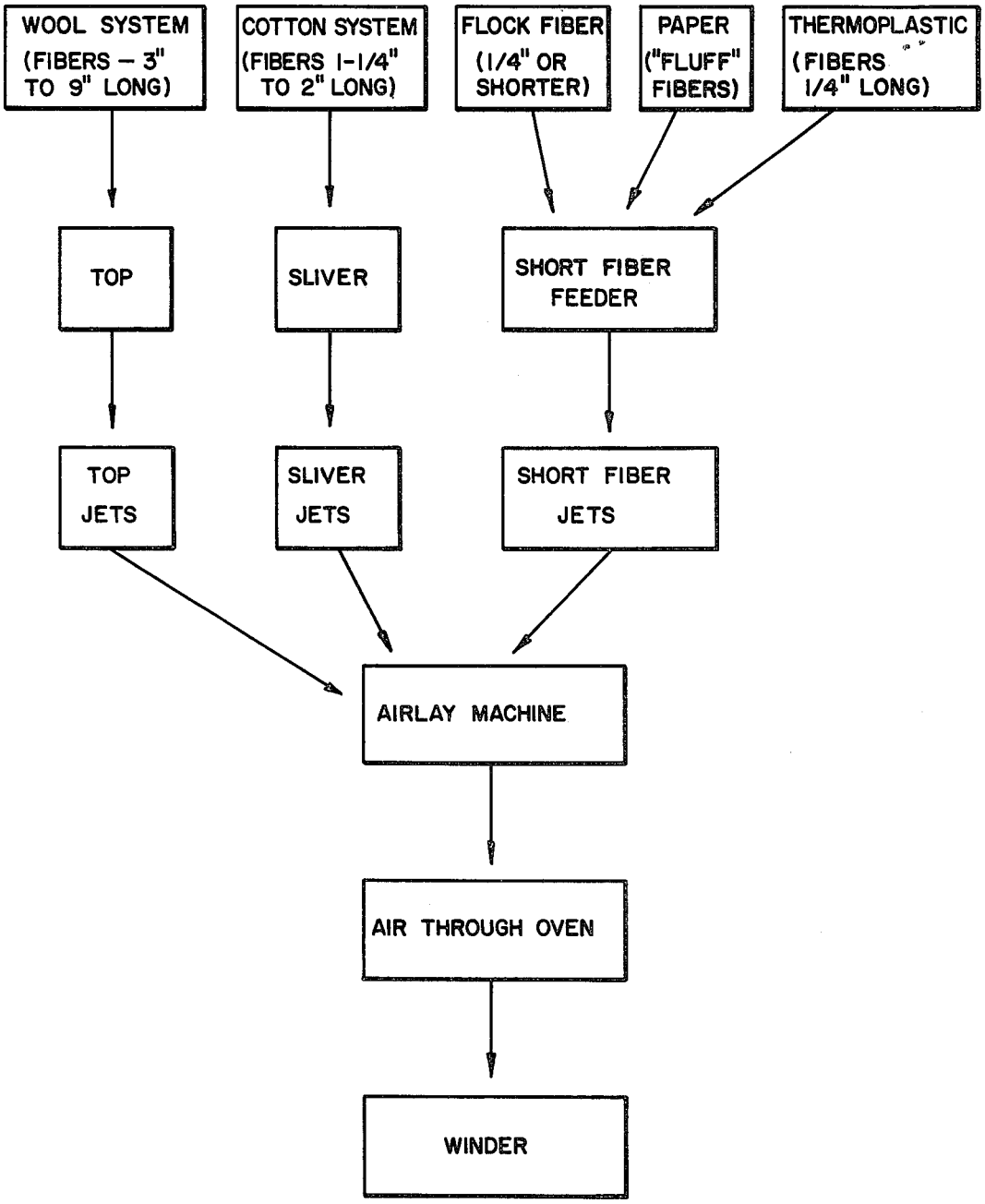
FIG. 1 is a flow sheet of the steps comprising the process of this invention.

As may be seen from the flow sheet, FIG. 1, a mixture of fibers of different lengths is fed to a plurality of aspirator jets, which in turn create an air-borne diffusion of intermingled and substantially individualized fibers, relatively free of clumps and fiber clusters. The nature of the feeding device supplying the fibers to the jets will of course vary with the fiber length and the nature of the fiber. Long fibers, 3 to 9 inches, may be processed into a top on the wool system, well known and needing no description here. Alternatively, a tow of continuous filaments may be cut on a Pacific Converter and pin-drafted to form a top of long staple fibers. Equally well known is the formation of shorter staple fibers into a sliver, using the cotton system of sliver preparation.

The short thermoplastic fibers, which may be mixed with equally short or shorter papermaking fibers (fluff fibers), may be fed to the aspirator jet by a variety of methods known in the art. One such method is to strip a veil of short fibers from a rotating toothed card or garnett roll, as by means of a vacuum slot operating at a vacuum of 10 to 30 inches of water, and to pipe the resulting air stream of short fibers to the jet for further diffusion and blending with the non-thermally sensitive fibers. Alternatively, processes such as are set forth in U.S. Pat. Nos. 3,577,290 or 3,616,035, to R. J. Baskerville et al, may be employed. These latter processes include the step of cutting a tow of continuous filaments into short staple fibers which are then diffused in air.

Again referring to FIG. 1, fibers of different staple lengths, from a plurality of jets, are fed to an air-lay machine. There are numerous ways of forming an air-borne diffusion of mixed fibers, and of collecting the fibers from the air stream in the form of a random web. The method set forth here is described in detail in my U.S. Pat. No. 3,812,553, and should be regarded as illustrative, not restrictive.

Figure 2:
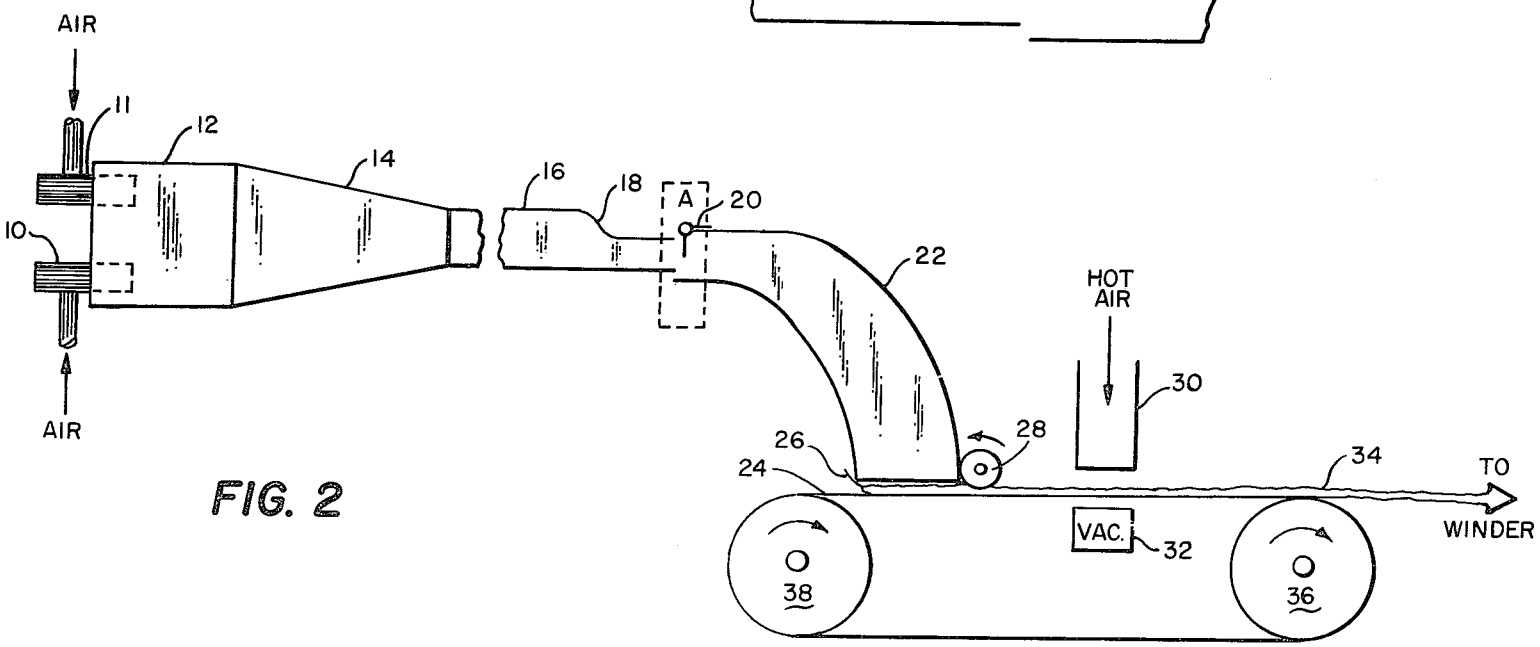
FIG. 2 represents a side elevation, partly broken away, of one type of apparatus suitable for carrying out the process of this invention.

Referring to FIG. 2, there is shown a pair of fluid-powered jets or aspirators, 10 and 11, each capable of converting a top or sliver or similar feed of staple fibers into high-velocity streams of substantially individualized fibers. Such jets, their parameters, and their function are described in detail in my U.S. Pat. No. 3,793,679 and U.S. Pat. No. 3,727,270, and there are also commercially available aspirators capable of performing a similar function.

Figure 4:
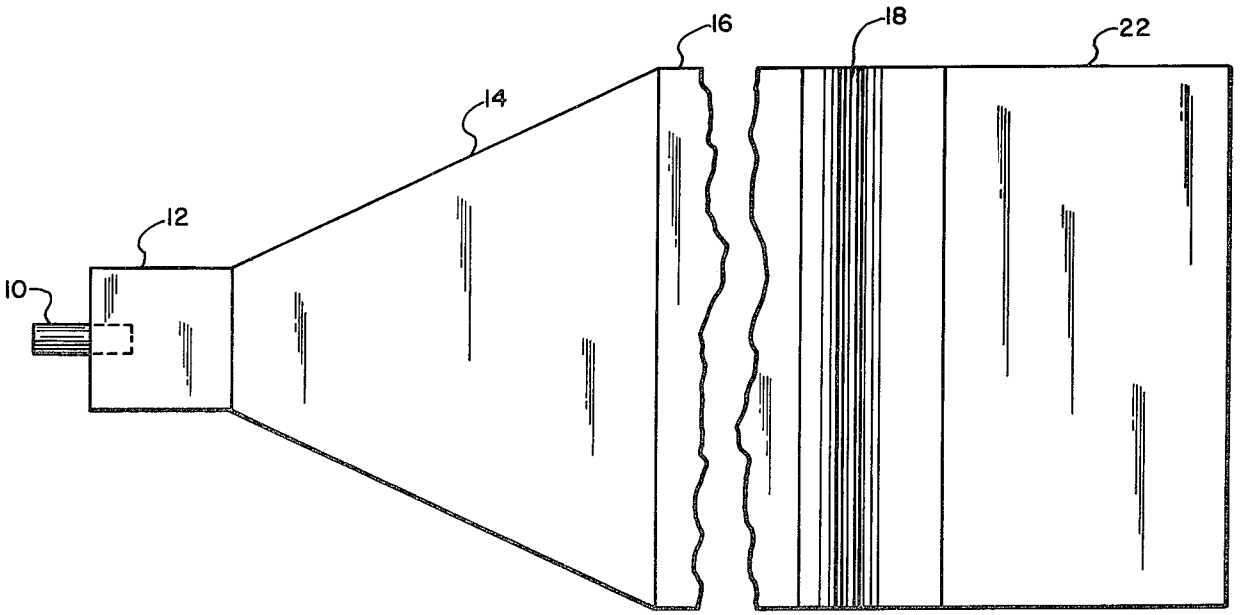
FIG. 4 is a top elevation, partly broken away, of the fiber-orientation section of FIG. 2.

The high-velocity fluid streams of fibers are directed into the entry chamber 12, and thence are diffused into a guiding chamber 14, which, as seen by comparing FIGS. 2 and 4, reforms the fibrous streams into a stream which is wider and shallower than the diffuse streams emerging from the aspirator. The wide and shallow fibrous stream flows then through the chamber 16 and preferably to a constricting region 18, which acts as a Venturi. While not absolutely mandatory, this constriction 18 serves to iron out or minimize local disruptive pressure difference or vortices, thus evening out the flow of fibers.

Figure 5:
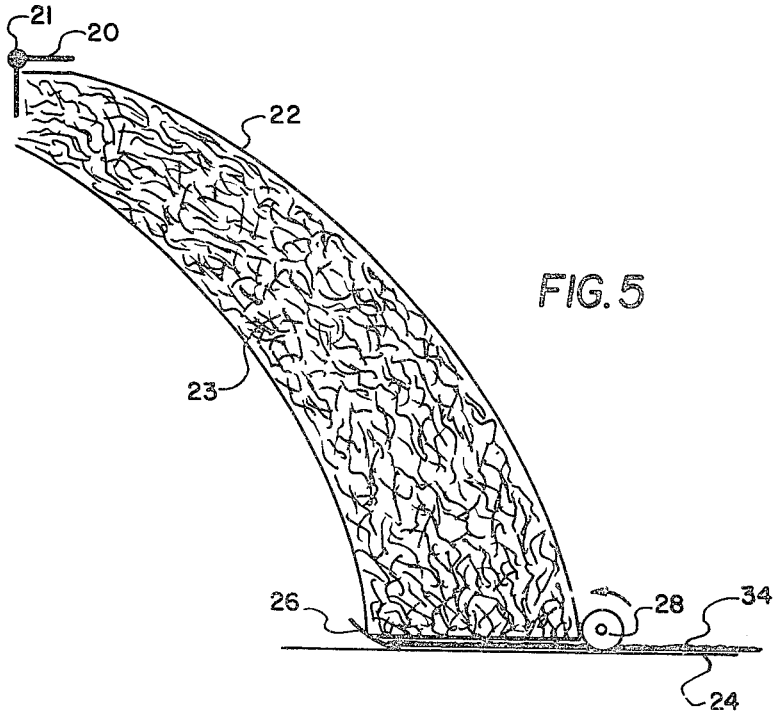
FIG. 5 is a magnified side view of the section 22 of FIG. 2.

From the Venturi section 18 the fibrous stream passes past the adjustable baffle or "spoiler" 20, which when in the position shown in FIG. 2 disrupts the smooth fluid flow of fibers, creating turbulence in the form of innumerable vortices and inequalities of air pressure in the centrifugal chamber 22, as shown in magnified detail in FIG. 5. In this manner, the centrifugal chamber 22 will be seen to be more or less uniformly filled with a randomly-oriented and dispersed stream of mixed fibers. Such streams of fibers yield webs which are substantially equal in M.D. and C.D. strength.

As explained in U.S. Pat. No. 3,812,553, the degree of reorientation can be controlled by the action of the spoiler 20, and can be more readily understood by reference to FIG. 3. The spoiler, as it is known in aerodynamic parlance, is a device which disrupts or disturbs the smooth flow of an air stream. As seen in partially broken-away FIG. 3, which is an enlargement of the dotted-line section A of FIG. 2, one convenient form of spoiler 20 consists of a right-angle bend of sheet metal, extending across the width of the curved centrifugal chamber 22, and hingedly connected as at 21 to the centrifugal chamber 22 so that it can be adjusted to extend downwardly into the fibrous stream. Other forms of adjustable baffle or spoiler will readily occur to those skilled in the art.

Figure 3:
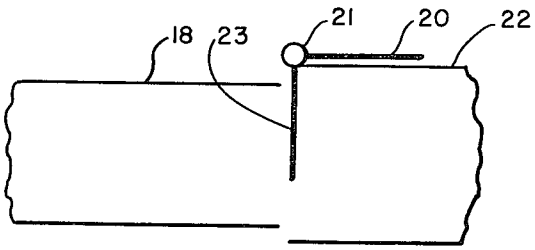
FIG. 3 is a magnified view of the section A of FIG. 2, enclosed by dotted lines.

If the spoiler is adjusted so that the vertical section or wing 23 of FIG. 3 is swung to a horizontal position parallel to the upper surface of the centrifugal chamber 22, there will be minimal interference with the smooth flow of the fibrous stream, and the long fibers in the stream will be predominantly oriented in the cross direction. Intermediate positioning of the wing 23 between horizontal and vertical will result in intermediate ratios of M.D. to C.D. strength in the resulting webs.

Whatever the degree of fiber orientation established in the centrifugal chamber 22, the curving stream of fibers passes downwardly and is collected on the porous screen 24, driven by rolls 36 and 38 as shown in FIG. 2. In order to prevent leakage in the transfer of the fibrous stream to the belt 24, a sealing roll 28 rotates on the screen blocking the egress of fiber-laden air from the front edge of the end of the centrifugal chamber 22, and a curved plastic strip 26 sealed to the lower rear edge of the centrifugal chamber 22 rides in contact with the moving screen, as shown more clearly in FIG. 5.

The size of the apparatus will naturally vary with the width of web to be produced, the volume of fiber to be processed, and with other factors. A typical set of dimensions might involve an entry chamber 12 in the form of a 10 inch cube. The guiding chamber 14 may taper down to a 4.5 l inch depth, while widening out to 40 inches for the purpose of producing a 40 inch-wide web. The chamber 16 may be 40 inches wide and 4.5 inches deep, with a cross section of 180 square inches.

The outlet slot of the Venturi section 18 may taper down to a depth of about 1.2 inches, ejecting a fibrous stream into the 2 inch deep opening of the centrifugal chamber 22. The guiding surfaces of this centrifugal chamber 22 are curved in a 15 inch radius through a 90° turn, terminating in an outlet section 6 inches wide, thus giving a 240 square inch screen deposition area.

The above dimensional parameters are illustrative only, and not restrictive. Engineering details for modifications of the apparatus may be made, bearing in mind that the centrifugal force developed is proportional to the square of the velocity of the air stream, and inversely proportional to the radius of curvature.

As seen in FIG. 2, the resulting fibrous web 34, carried on the porous conveyor 24, is subjected to a heating process while it remains in a substantially uncompressed condition. Various types of heating devices may be used, the instant illustration being one in which a stream of hot air from a heater 30 is drawn down through the web by means of a vacuum box 32, from which the exhaust hot air may be recycled (not shown). Depending on the web weight, the concentration of thermoplastic fiber, and on the processing speed desired, the air temperature in the hot air source may vary from 400° F to 1,000° F.

Also as noted in FIG. 2, it is desirable that the heating operation, which liquefies the thermoplastic fibers to fluid beads, be carried out on the web while the web is still supported on the porous screen on which it has been formed, and before any substantial drafting stress has been applied to the web. In this manner, the bonded products resemble the nonwoven fabric shown in FIG. 6, where for the sake of clarity only a few fibers are shown, in magnified detail, comprising a substantially random array of non-thermally sensitive fibers 40, hingedly interconnected to each other by fused beads of thermoplastic material 42. Occasionally there will be found beads of thermoplastic material 44 which encircle a solitary fiber, but the majority of the short thermoplastic and thermoretractile fibers retract and melt down in the heating process in such a fashion that they bond together two or more non-thermally sensitive fibers. In the heating operation which effects the bonding, thermal retraction occurs before fusion.

As mentioned above, in order to avoid shrinkage of the web as a whole, it is desirable that the thermally sensitive fibers be between 0.05 and 0.40 inches long, a range of 0.2 to 0.3 inches being especially preferred. The use of such short fibers advantageously insures that there is a widespread distribution of potential binding points because of the larger number of short fibers in a given fiber weight; that substantially no shrinkage of the web as a whole will occur, even at zero pressure; and that a more efficient use of the thermoplastic binder material will be achieved. Preferably, the thermosensitive fibers employed are only 0.2 to 0.3 inches in length when non-thermosensitive fibers of 1 to 2 inches in length are to be bonded. When non-thermosensitive fibers of 3 to 9 inches are to be bonded, the thermosensitive fibers may range up to 0.4 inches in length. With shorter non-thermosensitive fibers, the length of thermosensitive fibers may be as low as 0.05 inches. Since fibers of 0.05 to 0.4 inches cannot be carded or garnetted, the mixed fiber web of the present invention is formed in an air-lay system, such as is described above.

Another advantage in the use of short thermoplastic fibers is that the size and weight of such fibers, when melted to a bead, is much less than when textile-length thermoplastic fibers are used. Reduction of fiber to bonding beads is more complete with short fibers, with the formation of a large number of small bonding points, rather than a smaller number of larger beads. It has been found that with the use of short (0.4 inch or less) thermoplastic fibers, there is a greater tendency for the molten beads to concentrate at the crossover points of the larger non-thermoplastic fibers, with the consequence that the basic binder material is much more efficiently utilized.

As thermally sensitive fibers, there may be employed a wide variety of "binder fibers," as they are termed in the nonwoven industry: polyolefin fibers, undrawn polyester fibers, low-melting polyamide fibers, plasticized cellulose acetate fibers, copolymerized polyvinyl chloride-polyvinyl acetate fibers, and the like. Polyolefin fibers and polyvinyl chloride-polyvinyl acetate fibers are especially preferred.

The major portion of the fibers comprises non-thermally sensitive fibers or mixtures thereof, any stable textile fiber being suitable provided that there is a suitable discrepancy — for example, +100° F — between the melting point of the thermally sensitive fibers and the temperature at which the non-thermally sensitive fibers are affected. Fluid-borne streams of such fibers may utilize staple fibers which vary from 1 or 2 inches in length to 6 or 8 inches, or even longer. The formation of such fluid-borne streams is set forth in detail in my copending applications Ser. Nos. 159,229; 248,106; and U.S. Pat. No. 3,727,270.

Of course, various other expedients for forming a fluid-borne stream of intermingled long and short fibers may readily suggest themselves to those skilled in the art.

The invention will be illustrated by the following examples:

EXAMPLE 1

Using the apparatus depicted in FIG. 2, a fluid-borne stream of 1.5 inch 1.5 denier viscose fibers was diffused from one aspirator and a fluid-borne stream of 0.25 inch 3 denier polyvinyl chloride-polyvinyl acetate fibers was diffused from the other aspirator, forming a mixed diffusion of air-borne fibers which was randomized in the centrifugal chamber 22 with the spoiler as shown in FIG. 3. The web, supported on the porous screen 24, was subjected to a hot air treatment, without pressure, by the hot air blower 30 and vacuum box 32, the air temperature being about 450° F.

Figure 6:
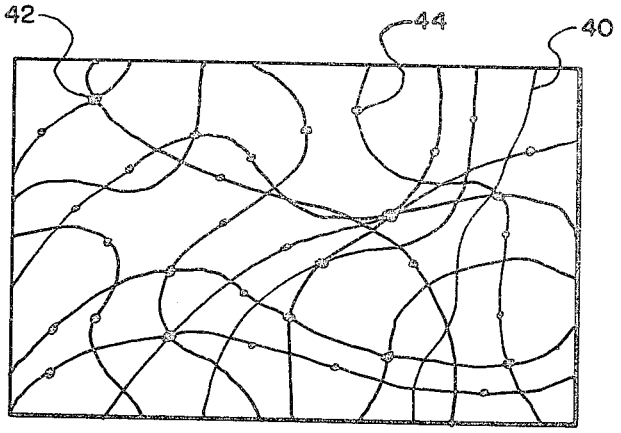
FIG. 6 is a representation of a typical product of the invention.

The final product weighed 10 grams per square yard and consisted of 80% rayon fibers, 20% vinyl copolymer in the form of small, essentially sperical beads, as in FIG. 6, said beads being located principally at the crossover points of the rayon fibers. The fabric had a tensile strength of 77 grams per inch-wide strip in the machine direction and 118 grams in the cross direction: tear strengths 68 grams machine direction, 50 grams cross direction.

EXAMPLE 2

Using the same apparatus as in Example 1, a fluid-borne stream of 1.5 inch 1.5 denier viscose fibers was diffused from one aspirator, and a stream of intermingled 0.25 inch 3 denier polyvinyl chloride-polyvinyl acetate fibers and paper fluff fibers of between 1,000 and 3,000 microns in length was diffused from the other aspirator. The mixed diffusion of the three types of fibers was again randomized in the centrifugal chamber 22 with the spoiler as shown in FIG. 3. Hot air bonding was carried out as in Example 1 without pressure.

The bonded product, again showing the characteristic bead-like bonding of FIG. 6, weighed 25 grams per square yard and was composed of 25% viscose fibers, 37.5% paper fluff fibers, and 37.5% fused vinyl copolymer. The tensile strengths were 222 grams per inch-wide strip machine direction, 185 grams cross direction. Tear strengths were 172 grams machine direction, 149 grams cross direction.

EXAMPLE 3

Again using the apparatus of Example 1, a fluid-borne stream of 0.25 inch 1.5 denier viscose fibers, 50% by weight, blended with 50% by weight of 0.25 inch 3 denier polyvinyl chloride-polyvinyl acetate fibers was diffused through one aspirator, and a fluid-borne stream of 6 inch 6 denier nylon fibers was diffused through the other aspirator. The mixed diffusion of the three types of fibers was again randomized in the centrifugal chamber 22 with the spoiler as shown in FIG. 3. Hot air bonding was carried out as in Example 1 without pressure.

This product also resembled the fabric of FIG. 6. It weighed 35 grams per square yard, and was composed of 30% viscose fibers, 40% nylon fibers, and 30% fused vinyl copolymer. The tensile strength in the machine direction was 740 grams per inch-wide strip, 1200 grams in the cross direction. Tear strengths were 730 grams machine direction, 1085 grams cross direction.

The bonded products of the three examples showed that a substantial number of the non-thermosensitive fibers were hingedly interconnected at their crossover points, so that all three products could be processed through subsequent stages of saturating, print bonding, laminating to tissue or other substrates, drying, slitting, and winding without destroying the essentially isotropic distribution of the fibers.

What is claimed is:

1. The process of stabilizing the relative orientation and distribution of the fibers in an air-laid web, the fibers of said web possessing a substantially random orientation comprising:

a. forming a substantially randomly oriented air-laid web comprising a major portion of non-thermally sensitive fibers, said non-thermally sensitive fibers having admixed therewith in random distribution and oriented throughout the length, breadth, and depth of said web, a minor proportion of fibers of a drawn, thermoplastic and thermoretractile nature which melt at a temperature below the melting point of said non-thermally sensitive fibers, said drawn thermoretractile fibers consisting essentially of fibers between 0.05 and 0.40 inches in length;

b. heating the mixed fiber web, substantially without pressure, sufficiently to cause said drawn thermoretractile fibers to retract and melt to a series of fluid beads, with a substantial loss of fiber identity, said beads locating principally at the crossover points of said non-thermally sensitive fibers by said drawn fibers retracting thereon; and, c. cooling said web until said fluid beads solidify so as to stabilize the relative orientation and distribution of the fibers in said web.

2. The process of claim 1 wherein said drawn thermoretractile fibers are polyolefin fibers.

3. The process of claim 1 including simultaneously admixing a proportion of paper fluff fibers with said non-thermally sensitive fibers and said drawn thermoretractile fibers during the forming of said air-laid web so as to be in random distribution throughout said web.

4. The process of claim 2 wherein said polyolefin fibers are a copolymer of polyvinyl acetate and polyvinyl chloride.

* * * * *